US005651415A

United States Patent [19]

Scales

[11] Patent Number: 5,651,415

[45] Date of Patent: Jul. 29, 1997

[54] SYSTEM FOR SELECTIVE RE-ENTRY TO COMPLETED LATERALS

[75] Inventor: Bert F. Scales, Houston, Tex.

[73] Assignee: Natural Reserves Group, Inc., Houston, Tex.

[21] Appl. No.: 535,472

[22] Filed: Sep. 28, 1995

[51] Int. Cl.[6] ..... E21B 33/10

[52] U.S. Cl. ..... 166/250.09; 166/50

[58] Field of Search ..... 166/250.09, 313, 166/50, 380

[56] References Cited

U.S. PATENT DOCUMENTS

| | | | |
|---|---|---|---|
| 3,046,601 | 7/1962 | Hubbert et al. | 166/250.09 |
| 3,855,854 | 12/1974 | Hutchison et al. | 73/151 |
| 3,855,855 | 12/1974 | Hutchinson et al. | 73/151 |
| 3,855,856 | 12/1974 | Hutchison et al. | 73/151 |
| 3,963,654 | 6/1976 | Hutchison et al. | 260/5 |
| 4,396,075 | 8/1983 | Wood et al. | 175/79 |
| 4,415,205 | 11/1983 | Rehm et al. | 299/5 |
| 4,573,541 | 3/1986 | Josse et al. | 175/78 |
| 4,616,987 | 10/1986 | Boyers et al. | 425/89 |
| 4,742,871 | 5/1988 | Miffe | 166/117.5 |
| 5,301,760 | 4/1994 | Graham | 175/61 |
| 5,311,936 | 5/1994 | McNair et al. | 166/50 |
| 5,318,121 | 6/1994 | Brockman et al. | 166/313 |
| 5,318,122 | 6/1994 | Murray et al. | 166/313 |
| 5,322,127 | 6/1994 | McNair et al. | 166/313 |
| 5,325,924 | 7/1994 | Bangert et al. | 166/313 |
| 5,330,007 | 7/1994 | Collins et al. | 166/313 |
| 5,353,876 | 10/1994 | Curington et al. | 166/313 |
| 5,388,648 | 2/1995 | Jordan, Jr. | 166/380 |
| 5,533,573 | 7/1996 | Jordan, Jr. et al. | 166/313 |

*Primary Examiner*—William P. Neuder
*Attorney, Agent, or Firm*—Kurt S. Myers

[57] ABSTRACT

The present invention is directed to a method for the entry of a tool from a cased wellbore into a lined and sealed completed lateral which includes the steps of measuring the distance from at least one apex of the ellipse formed by the intersection of the completed lateral and the wellbore to a fixed point in the wellbore and aligning a re-entry device from the fixed point to allow the tool to enter the lateral from the cased wellbore. The fixed point in the wellbore may be a keyway in a joint of the casing or a keyway in a packer positioned in the wellbore. The invention further includes the apparatus for measuring the distance from the fixed point which includes an inflatable packer with an outside memory-retention surface and a tail joint having a guide key which seats in the key slot.

8 Claims, 6 Drawing Sheets

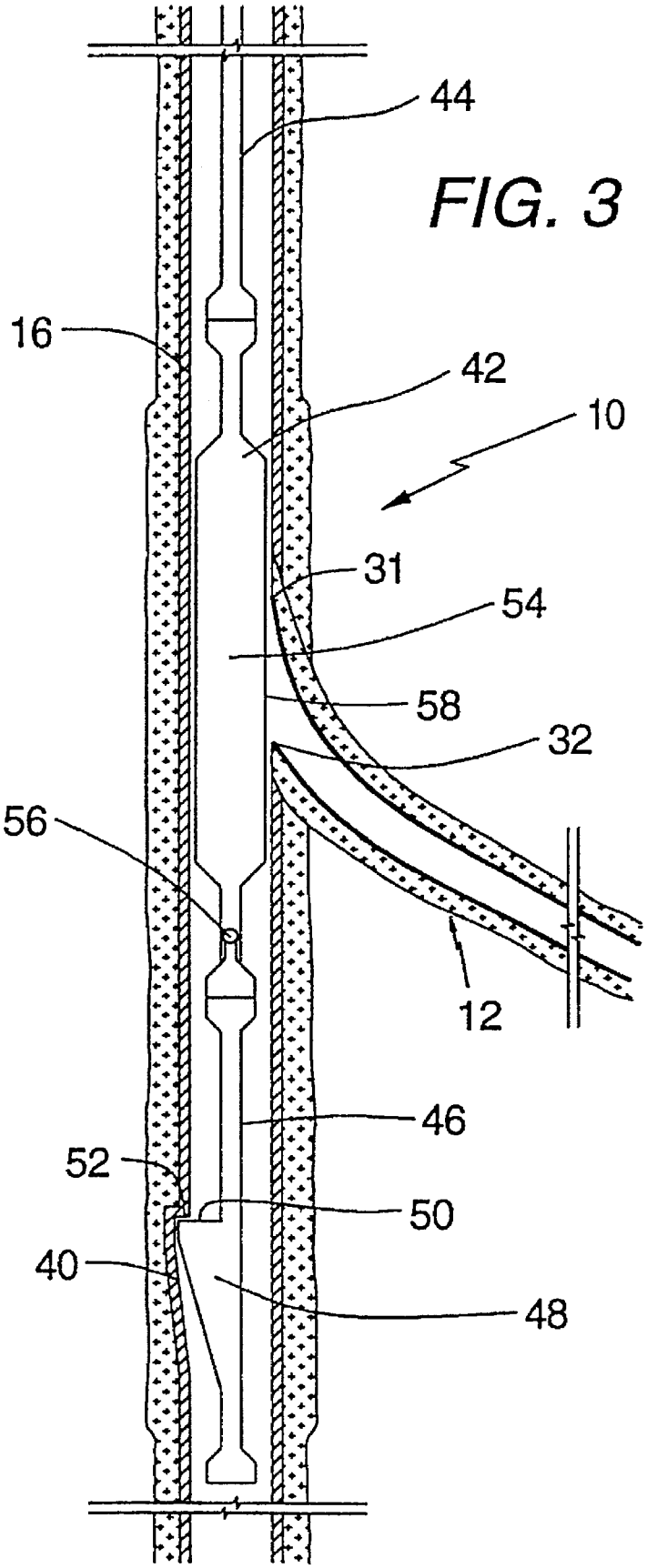
FIG. 3
FIG. 3 A
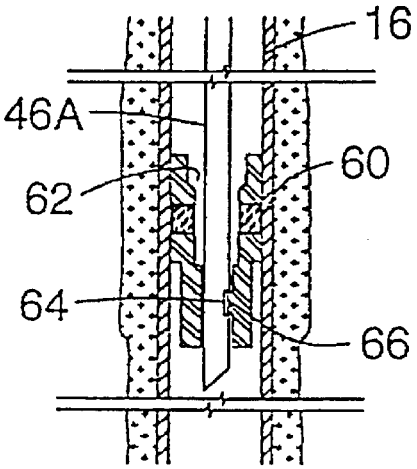

SYSTEM FOR SELECTIVE RE-ENTRY TO COMPLETED LATERALS

FIELD OF THE INVENTION

The present invention is directed to method and apparatus for the selective re-entry to completed laterals from a wellbore. More specifically, the present invention is directed to a system for the selective re-entry to completed laterals from a vertical well.

BACKGROUND OF THE INVENTION

The detailed background of the present invention is disclosed in U.S. Pat. No. 5,301,760 granted Apr. 4, 1994, which is incorporated herein by reference. In summary, a completed lateral or horizontal drainhole is produced by cutting or milling a window through the casing in a well borehole using a whipstock to provide the desired direction, the lateral or horizontal drainhole is completed by sealing a pipe string or liner which extends from the wellbore at least through the curved portion of the lateral, providing a sealed interface between the cased wellbore and the lateral; and the cased wellbore is restored by removing any sealant and/or pipe in the cased portion of the wellbore with a burning shoe.

The system of the present invention is directed to the selective re-entry to a completed lateral or horizontal drainhole for the purpose of cleanout operations, sand control methods, stimulation, and/or any other operation which is carried out in the lateral.

U.S. Pat. Nos. 5,311,936; 5,318,121; 5,318,122; 5,322,127; 5,325,924; 5,353,876; and 5,388,648, all patents having essentially the same disclosure and assigned to Baker Hughes Incorporated, disclose a number of methods and apparatus for sealing the juncture between a vertical well and one or more horizontal wells. The disclosure of U.S. Pat. No. 5,322,127 is incorporated herein by reference.

U.S. Pat. No. 4,396,075 discloses a method for drilling and completing multiple branch wells extending from a main generally vertical hole.

U.S. Pat. No. 4,415,205 discloses a method and apparatus to complete multiple branch wells using separate drill and casing templates.

U.S. Pat. No. 4,573,541 discloses a multi-drain drilling and petroleum start-up device.

U.S. Pat. No. 4,742,871 discloses device for positioning a tool within a wellbore flow string.

U.S. Pat. No. 5,330,007 discloses a template and process for drilling and completing multiple wells.

In all the patents cited above, the re-entry into a lateral or horizontal borehole requires the structure used in producing the lateral. None of the patents disclose the re-entry of a completed lateral where the structure for making the lateral has been removed.

SUMMARY OF THE INVENTION

The present invention is directed to a method for the entry of a tool from a cased wellbore into a lined and sealed completed lateral which includes the steps of measuring the distance from at least one apex of the ellipse formed by the intersection of the completed lateral and the wellbore to a fixed point in the wellbore and aligning a re-entry device from the fixed point to allow the tool to enter the lateral from the cased wellbore. The fixed point in the wellbore may be a keyway in a joint of the casing or a keyway in a packer positioned in the wellbore. The invention further includes the apparatus for measuring the distance from the fixed point which includes an inflatable packer with an outside memory-retention surface and a tail joint having a guide key which seats in the key slot.

BRIEF DESCRIPTION OF THE DRAWINGS

FIG. 3 is a cross-sectional elevational view showing the first stage of the method which positions a packer having an outside memory-retention surface adjacent the lateral opening using a key slot in the casing to take an impression of the lateral opening;

FIG. 3A is a cross-sectional view of a packer having a key slot as an alternative for the key slot in the casing to position the packer shown in FIG. 3.

DESCRIPTION OF THE PREFERRED EMBODIMENTS

The present invention is directed to a method for the re-entry of a tool from a cased wellbore into a lined and sealed completed lateral. A lined and sealed lateral may be completed according to the method disclosed in U.S. Pat. Nos. 5,301,760 or 5,322,127, both disclosures being incorporated herein by reference. In U.S. Pat. No. 5,301,760, the sealing material is an impermeable hardenable material, such as a cement slurry. In U.S. Pat. No. 5,322,127, the sealing material may be several different materials including an inflatable device, such as an inflatable mold.

Figure 1:
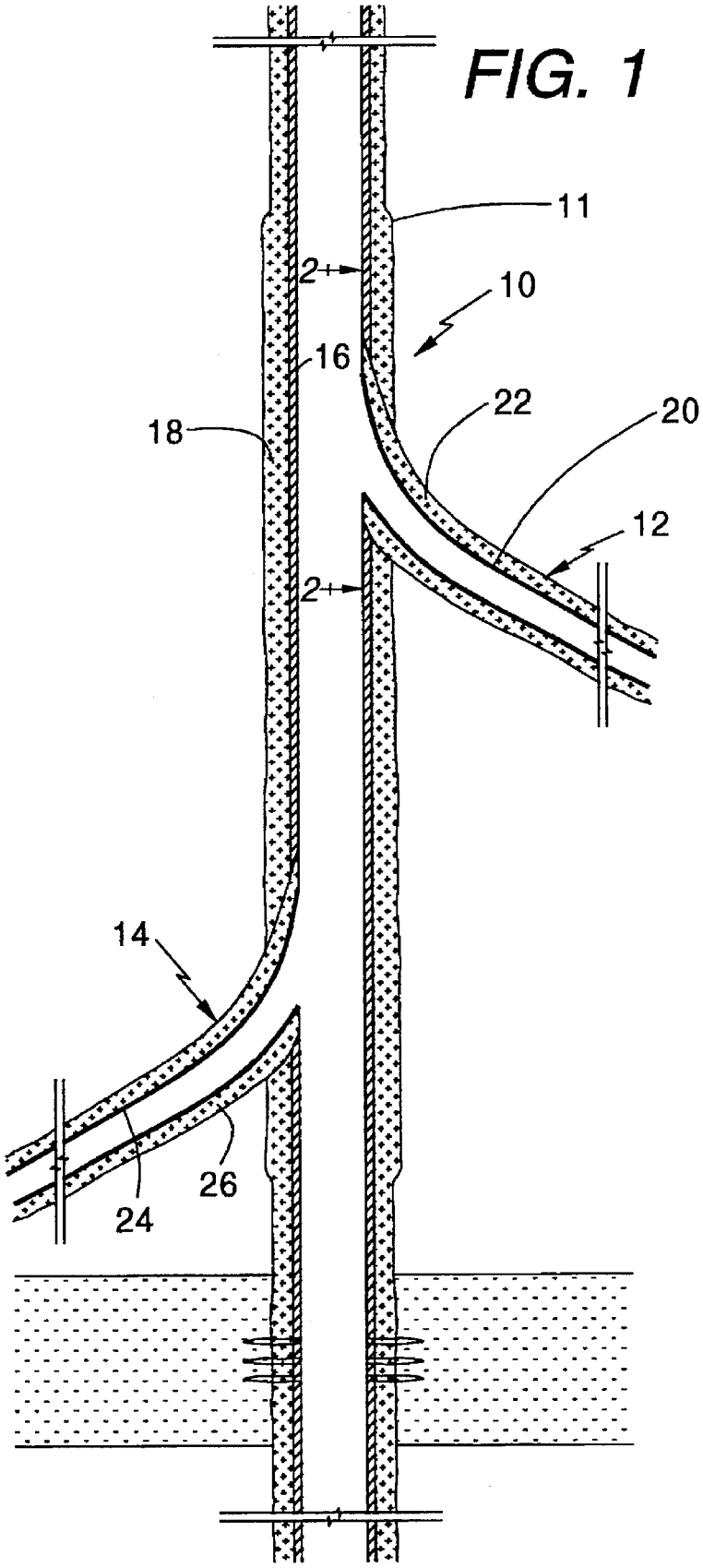
FIG. 1 is a cross-sectional view of a multi-lateral well showing two cased and sealed laterals which extend from the cased vertical wellbore.

Referring now to FIG. 1, a multi-lateral well 10 having at least one borehole, illustrated as a vertical borehole 11, has two laterals 12 and 14. The method for producing the laterals 12 and 14 is described in detail in U.S. Pat. No. 5,301,760. The borehole 10 has a casing 16 and is cemented in place with cement 18. The lateral 12 has a casing 20 and is sealed in place by cement 22. Likewise, lateral 14 has a casing 24 and is sealed in place by cement 26.

Figure 2:
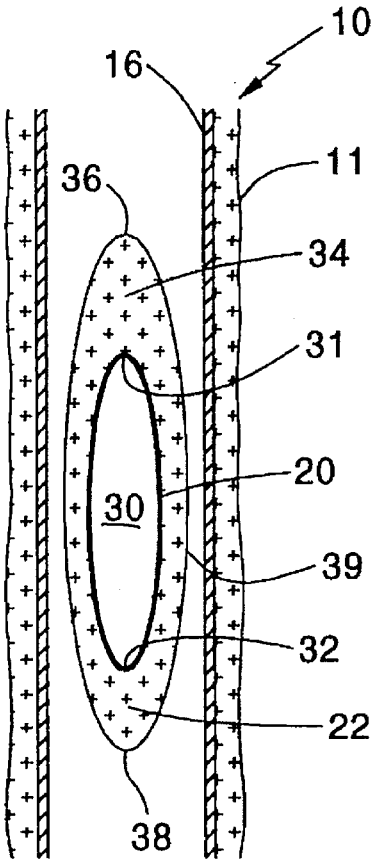
FIG. 2 is a cross-sectional side view of the opening to one lateral shown in FIG. 1, taken along line 2—2 thereof.

FIG. 2 is a cross-sectional view of the opening to the lateral 12. The opening 30 to lateral 12 is a ellipse with an upper apex 31 and a lower apex 32. The sealing material 34, such as cement 22, seals the opening in the casing 16, the ellipse cut into the casing 16 when the lateral is produced, from the formation. The ellipse cut into the casing 16 has an upper apex 36 and a lower apex 38.

FIG. 2 illustrates the problem which the present invention solves. To re-enter the lateral 12, a tool must find the opening 30 which is defined by the upper apex 31 and the lower apex 32. However, in producing the lateral 12 the only logged depth may be the depth of the whipstock which produced the opening 39 defined by the upper apex 36 and the lower apex 38. There is no disclosure of any re-entry in the above patents. Furthermore, it can not be assumed that the cutting tool making the opening 39 cut an opening which is exactly the size of the tool head. Neither can it be assumed that the casing placed and sealed in the lateral is equally distant or centered in the lateral opening 39. Therefore it is the object of the present invention to provide a method to clearly find the opening 30 so that re-entry to the lateral is accomplished with a properly positioned re-entry device and the tools to perform any number of operations in the lateral will enter the opening 30 and not be impeded by the sealing material 34 sealing that portion between the opening 39 and the casing 20 in the lateral 12.

Referring now to FIG. 3, the first stage of the re-entry to the lateral 12 of multi-lateral well 10 is illustrated, with the same reference numbers used in this and subsequent figures referring to the same structure in each figure. The well 10 has a casing 16. In this embodiment, the casing 16 has a casing joint with a key slot 40 which is located below the lateral 12. The depth and azimuth, i.e. the distance from a measuring point at the surface of the well 10 and the exact location in angular degree from North, of the key slot 40 has been determined upon completion of the cementing of the casing 16 in the well 10 or is the first step of the present method. With the knowledge of the depth of the key slot 40 and the approximate depth of the lateral 12, a packer assembly 42 is lowered on a work string 44. The packer assembly 42 has a tail joint 46 attached to the bottom of the packer assembly 42. The tail joint 46 has a guide key 48 which when the tail joint 46 is rotated will expand into the key slot 40 in the casing 16. The work string 44 is then lifted to engage the upper surface 50 of the guide key 48 with the surface 52 of the key slot 40 which fixes a known point in the wellbore of well 10. The seating of the guide key 48 in the key slot 40 fixes the packer 54 of packer assembly 42 adjacent the lateral 12. A weighted packer setting ball 56 travels through the work string 44 and the packer assembly 42 to seat in a seal profile (not shown) which allows the inflating of the packer 54. The packer 54 has an outside memory-retention surface 58 which makes a surface impression on the surface 58 of the opening 30 and the surrounding surfaces upon expansion of the packer 54 against those structures. Packers having memory-retention surfaces are known in the art and are illustrated by U.S. Pat. Nos. 3,855,854; 3,855,855; 3,855,856; and 3,963,654. An alternative to an inflatable packer is described in U.S. Pat. No. 4,616,987. The primary desired impression is the configuration of the opening 30 and the position of the apexes 31 and 32. After completing the impression of the opening 30, the packer 54 is deflated, the guide key 48 is removed from the key slot 40 and the packer assembly 42 and tail joint 46 are pulled from the well 10 by the work string 44. The packer 54 is inflated at the surface for measuring the distance from the surface 50 of the guide key 40 to the impressions on the packer surface 58 indicating the apex 31 and 32 of the opening 30.

FIG. 3A illustrates that the key slot may be located in the wellbore other than in the casing. A packer 60 is set below the lateral 12 in the well 10. The tail joint 46A used in this alternative enters the opening 62 and has a key slot 64 into which a guide key 66 on the packer 60 sets and orientates the packer 54 (not shown). It is clear that the purpose of the key slot and key guide is to provide a fixed point in the wellbore to provide the distance measurement from that fixed point to the apexes impressed on the packer surface. Also as will be described hereinafter, the fixed point provides the base to fix the re-entry device for assured entry into a desired lateral by tools required to carry out any desired operation in the lateral.

Figure 4:
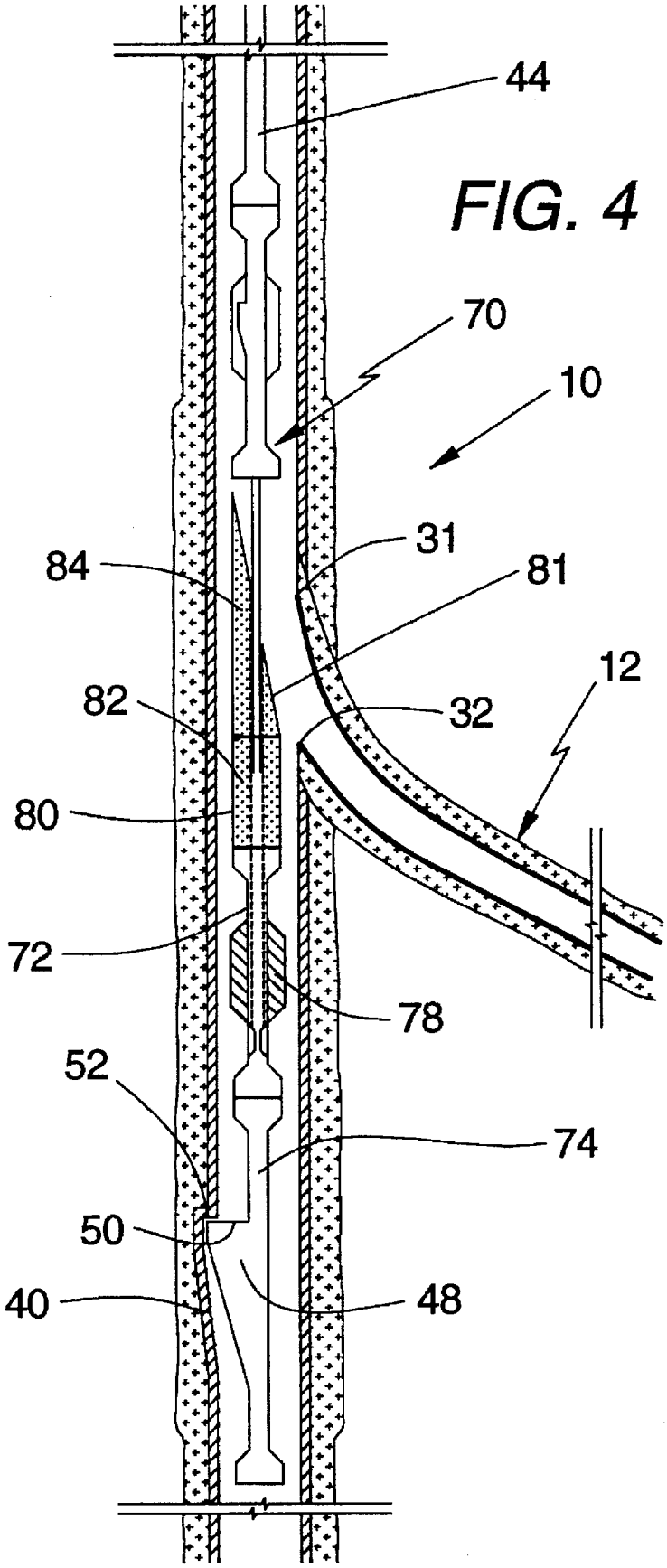
FIGS. 4–7 are cross-sectional elevational views showing the sequential stages of the present invention to provide an aligned re-entry device which is aligned with the lateral to allow a tool to enter the lateral from the wellbore.
Figure 5:
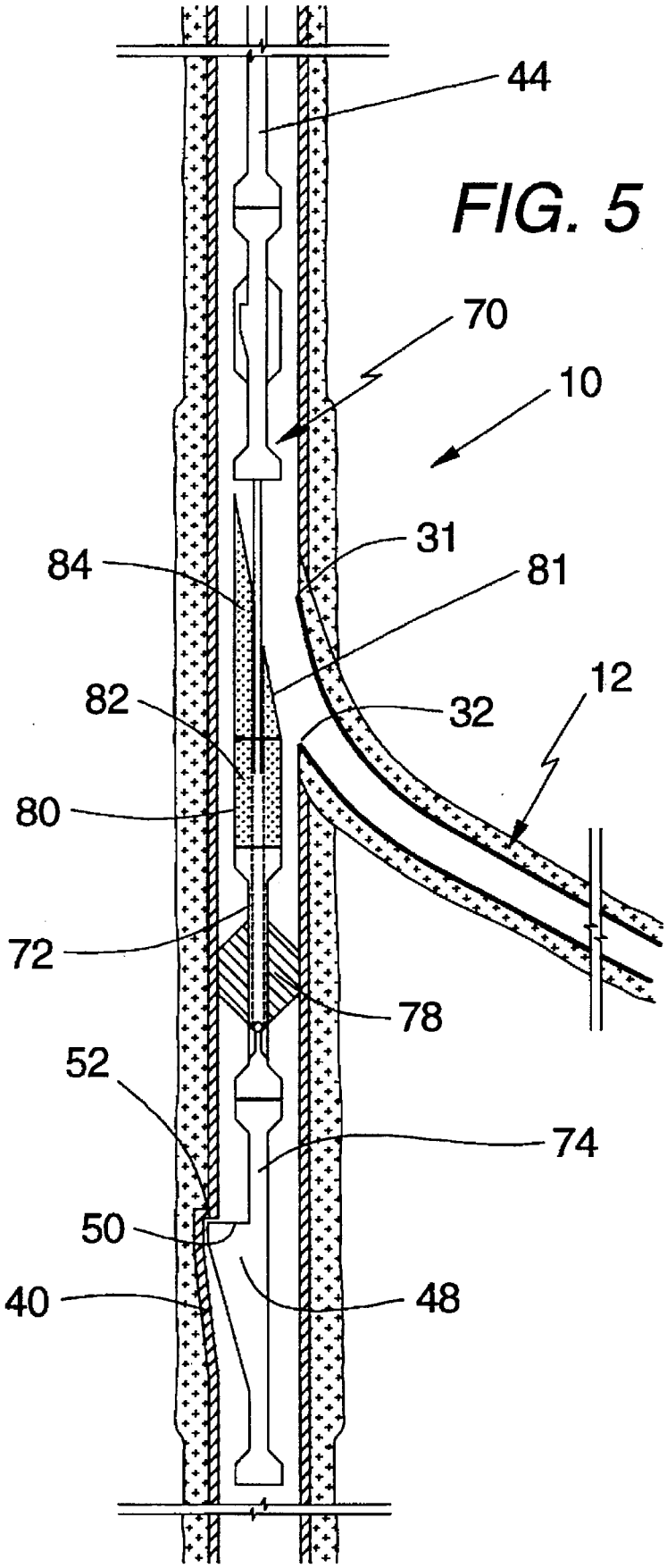
Figure 6:
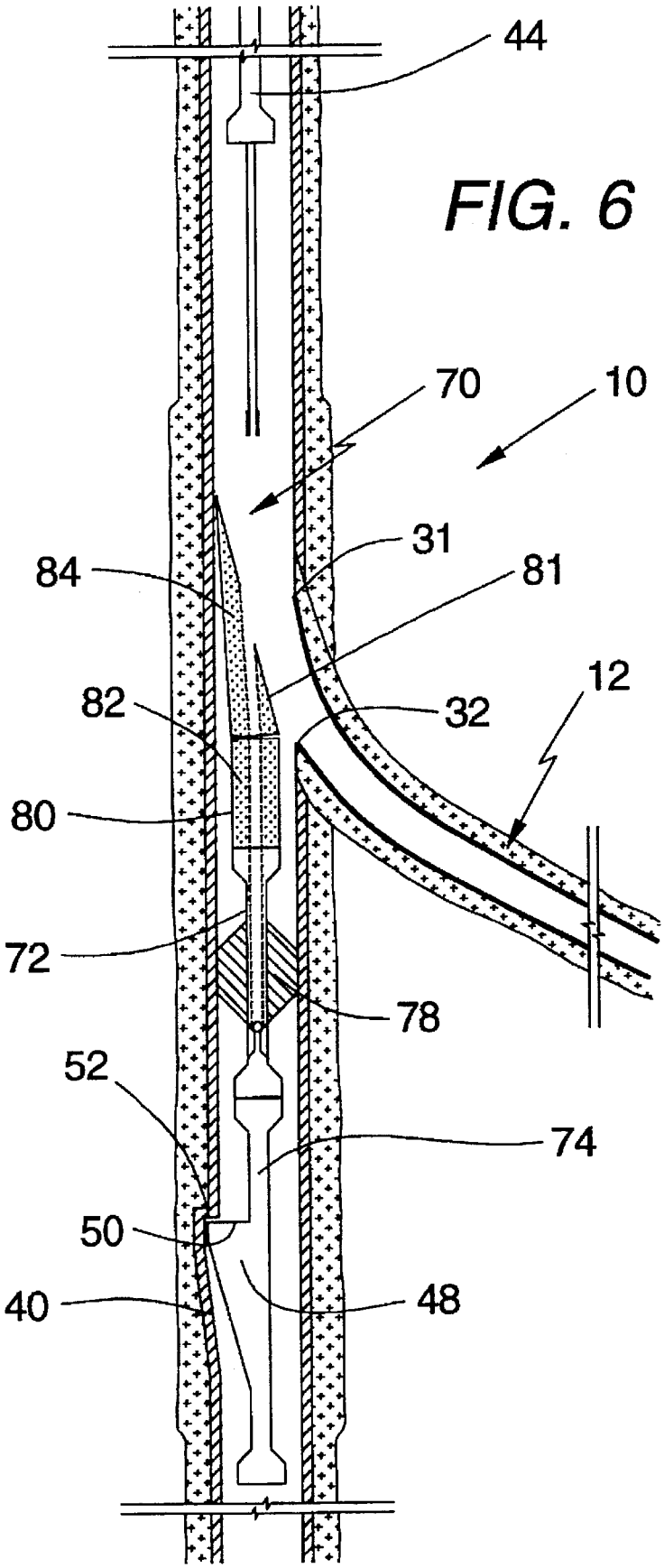

Referring now to FIGS. 4–6 which illustrate the setting of the re-entry device for assuring entry into the desired lateral, the work string 44 lowers a re-entry device assembly 70 having a packer assembly 72 and then a tail joint 74 attached to the assembly 70 as shown in FIG. 4. The key guide 48 is positioned in the key slot 40 and the work string 40 raised to assure that the surface 50 and 52 are in contact. While holding the string in this position, a weighted packer setting ball is passed through the work string 44, the re-entry device assembly 72 and the packer assembly 72 to a seat (not shown) at the lower end of packer assembly 72 and the packer 78 is set as shown in FIG. 5. At the surface before the operation just described is carried out, the measured distance and orientation in azimuth, obtained from the impression packer 54, from the fixed point (the interlocking of the key guide 48 into the key slot 40 such that the surfaces 50 and 52 are in engagement) to the apex 32 and/or 31 is used to properly align the re-entry device 80 and more particularly, the surface 81 of the re-entry device 80 to assure that any tool introduced will enter the desired lateral 12.

The illustrated or preferred embodiment of the re-entry device 80 is a whipstock 82. The specific whipstock 82 has a upper portion 84 and a lower portion and is described in more detail in U.S. Pat. No. 5,301,760. When the carrying rod 88 is sheared and removed from the whip stock 82, as shown in FIG. 6, the upper portion 84 which is spring loaded will tilt to the surface of the casing 16 opposite the opening 30 of the lateral 12. The re-entry device 80 is now ready for the tools used in any operation to be carried out in the lateral 12 to be introduced into the cased wellbore through the casing 16.

Figure 7:
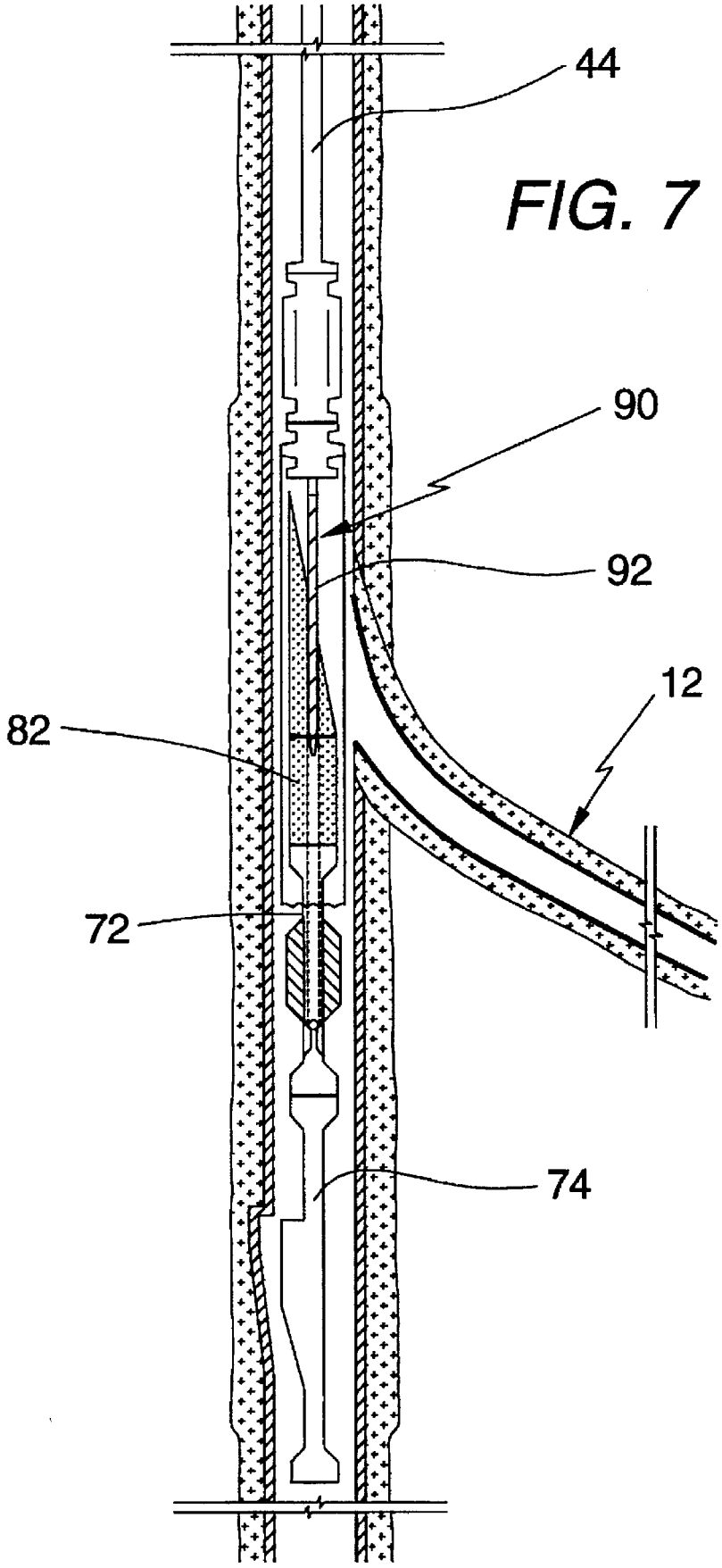

Referring now to FIG. 7, this figure illustrates the removal of the re-entry device 80 to either have the full flow of the well 10 restored or to restore the well 10 so that a re-entry device may be set at another lateral. A work string 44 lowers a retrieving assembly 90 to the re-entry device 80. The retrieving assembly 90 has a stinger 92 which serves as a means to deflate the packer 78 and also has a screw taper tap which secures the whipstock 82 so that the entire assembly can be raised to the surface.

I claim:

1. A method for the entry of a tool from a cased wellbore into a lined and sealed completed lateral after the device used to form the lateral has been removed, said lined lateral forming an elliptical opening in the cased wellbore, which comprises:

measuring the distance from at least one apex of said elliptical opening to a fixed point in said wellbore, and aligning a re-entry device from said fixed point in said wellbore to allow said tool to enter said lateral from said wellbore.

2. A method according to claim 1 wherein said fixed point is a key slot in said cased wellbore.

3. A method according to claim 1 wherein said fixed point is within a packer in said wellbore.

4. A method according to claim 2 wherein said key slot is below said lateral.

5. An apparatus for measuring the distance from a fixed point in a wellbore to at least one apex of an ellipse formed by an intersection of a completed lateral and the wellbore which comprises:

an inflatable packer having an outside memory-retention surface; and a tail joint which is connected under said inflatable packer, said tail joint having a guide key having at least one surface which seats into a key slot positioned in said wellbore.

6. An apparatus according to claim 5 which further includes:

a tubing section which extends through said packer; and a tubing string connected to said tubing section for passing fluid to inflate said packer.

7. A method for the entry of a tool into a sealed and completed lateral containing a liner from a cased wellbore having a casing joint below said lateral with a key slot, said completed lateral forming an elliptical opening in the wellbore, which comprises:

running an inflatable packer on a tail joint with a guide key into said cased wellbore, said guide key having at least one surface which seats in said key slot and said tail joint positioning said packer adjacent said completed lateral;

inflating said packer, said packer having an outside memory-retention surface, to obtain an image of said elliptical opening of said completed lateral;

deflating said packer and pulling said packer and tail joint to said surface to measure the distance from at least one apex of the ellipse formed by the intersection of said completed lateral impressed on said packer and said surface on said guide key and to obtain a measured distance; and running and aligning a re-entry device having a tail joint with a guide key into said cased wellbore, the length of said tail joint being determined by said measured distance to align said re-entry device with said apex of said completed lateral and allow said tool to enter said lateral from said wellbore.

8. A method for the entry of a tool into a sealed and completed lateral containing a liner from a cased wellbore having a packer below said lateral with a key slot, said completed lateral forming an elliptical opening in the wellbore, which comprises:

running an inflatable packer on a tail joint with a guide key into said cased wellbore, said guide key having at least one surface which seats in said key slot and said tail joint positioning said packer adjacent said completed lateral;

inflating said packer, said packer having an outside memory-retention surface, to obtain an image of said elliptical opening of said completed lateral;

deflating said packer and pulling said packer and tail joint to said surface to measure the distance from at least one apex of the ellipse formed by the intersection of said completed lateral impressed on said packer and said surface on said guide key and to obtain a measured distance; and running and aligning a re-entry device having a tail joint with a guide key into said cased wellbore, the length of said tail joint being determined by said measured distance to align said re-entry device with said apex of said completed lateral and allow said tool to enter said lateral from said wellbore.

* * * * *